US005794595A

United States Patent [19]

Berger et al.

[11] Patent Number: 5,794,595

[45] Date of Patent: Aug. 18, 1998

[54] MOUNTING ARRANGEMENT FOR A FUEL INJECTOR HOLDER

[75] Inventors: Frank Berger, Leutenbach; Bernhard Schwarzkopf, Waldstetten, both of Germany

[73] Assignee: Daimler-Benz AG, Stuttgart, Germany

[21] Appl. No.: 892,031

[22] Filed: Jul. 14, 1997

[30] Foreign Application Priority Data

Jul. 24, 1996 [DE] Germany ..... 196 29 855.5

[51] Int. Cl.[6] ..... F02M 55/02

[52] U.S. Cl. ..... 123/470

[58] Field of Search ..... 123/470, 472, 123/509

[56] References Cited

U.S. PATENT DOCUMENTS

| | | | |
|---|---|---|---|
| 3,038,456 | 6/1962 | Dreisin | 123/470 |
| 3,334,617 | 8/1967 | Palkowsky | 123/470 |
| 4,203,402 | 5/1980 | Freyn | 123/470 |
| 4,206,725 | 6/1980 | Jenkel et al. | 123/470 |
| 4,894,900 | 1/1990 | Rausfeisen et al. | 29/256 |
| 5,329,906 | 7/1994 | Jensen et al. | 123/470 |
| 5,566,658 | 10/1996 | Edwards et al. | 123/470 |
| 5,697,345 | 12/1997 | Genter et al. | 123/470 |

FOREIGN PATENT DOCUMENTS

| | | |
|---|---|---|
| 44 13 415 | 6/1995 | Germany . |
| 2 145 469 | 3/1985 | United Kingdom . |
| WO 80/01189 | 6/1980 | WIPO . |

*Primary Examiner*—Thomas N. Moulis
*Attorney, Agent, or Firm*—Klaus J. Bach

[57] ABSTRACT

In a mounting arrangement for a fuel injector holder disposed in an injector holder recess formed in the cylinder head of an internal combustion engine and held therein by a clamping pawl whose one end is seated on a support surface of the cylinder head and whose opposite forked end has engagement fingers engaging support surfaces at opposite sides of the injector holder and which is screwed onto the cylinder head for biasing the injector holder into the injector holder recess, the injector holder has a shoulder and the screw has a head with a projection extending under the shoulder for pulling the injector holder out of the injector holder recess when the screw is unscrewed from the cylinder head.

5 Claims, 1 Drawing Sheet

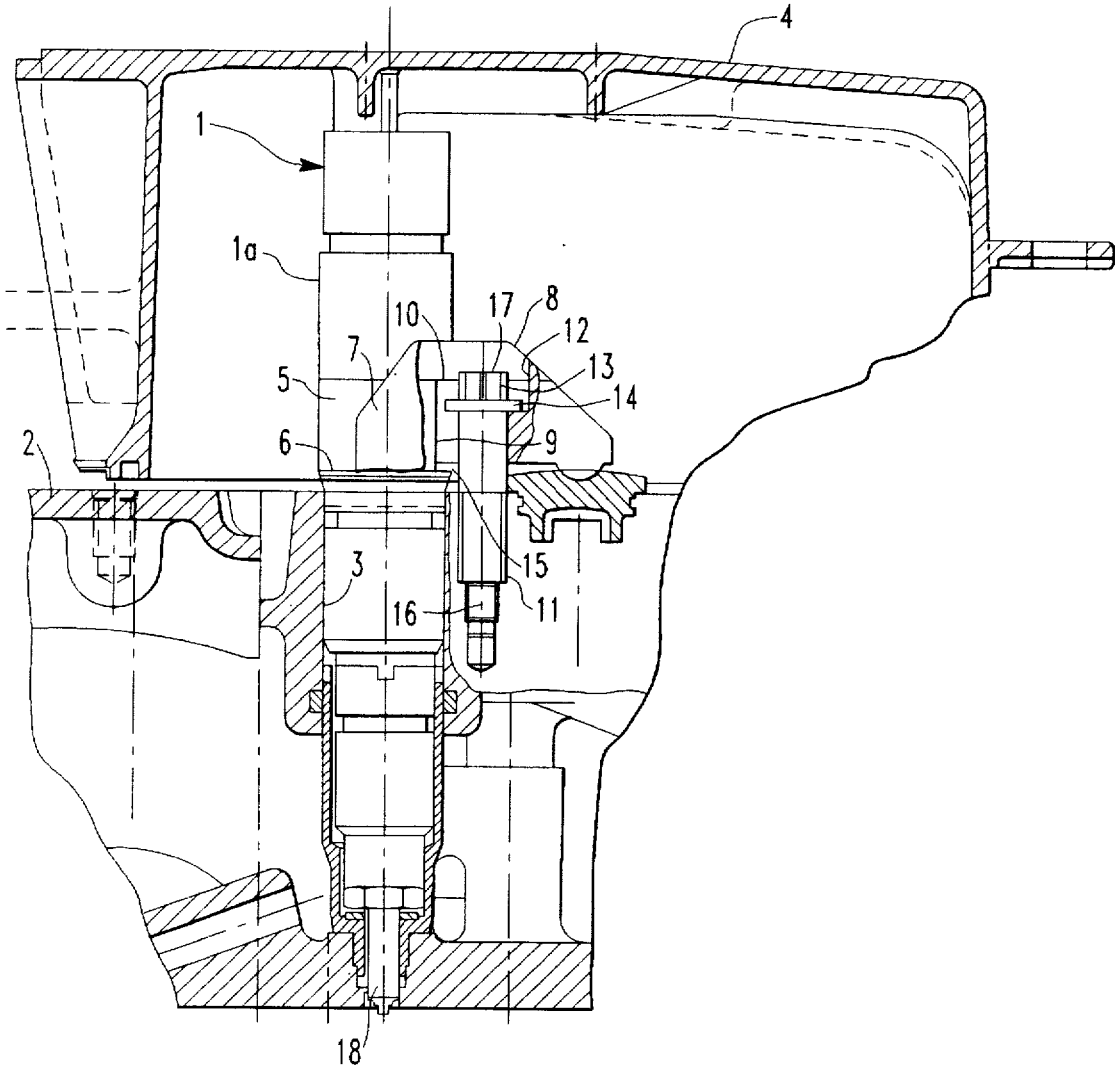
4
1
1a
10
17
8
12
7
13
5
14
2
6
9
15
3
11
16
18

MOUNTING ARRANGEMENT FOR A FUEL INJECTOR HOLDER

BACKGROUND OF THE INVENTION

The invention relates to a mounting arrangement for a fuel injector holder in a mounting recess formed in the cylinder head of an internal combustion engine utilizing a fork-like clamping pawl engaging with one end a shoulder formed on the injector holder and being supported at its opposite end on the cylinder head on which the clamping pawl is mounted by a mounting bolt.

Such an arrangement is disclosed in DE 44 13 415 C1 wherein an injector holder received in a bore is forced onto a seat in the bore by a clamping pawl mounted onto the cylinder head by a mounting bolt.

The mounting of such a fuel injector holder is relatively simple since the fuel injector only needs to be inserted onto the mounting recess and is then pressed into, and held in, the recess by the clamping pawl which is forced onto the injector holder by a mounting screw. This way of mounting provides for firm seating of the fuel injector holder in the mounting recess.

However, removal of the fuel injector holder is often difficult since after removal of the mounting screw and of the clamping pawl the injector holder is often still firmly engaged in the mounting recess.

It is the principal object of the present invention to provide a simple mounting arrangement for a fuel injector holder whereby a fuel injector holder can be firmly held in its mounting recess and easily and rapidly removed if this becomes necessary.

SUMMARY OF THE INVENTION

In a mounting arrangement for a fuel injector holder disposed in an injector holder recess formed in the cylinder head of an internal combustion engine and held therein by a clamping pawl whose one end is seated on a support surface of the cylinder head and whose opposite forked end has engagement fingers engaging support surfaces at opposite sides of the injector holder and which is screwed onto the cylinder head for biasing the injector holder into the injector holder recess, the injector holder has a shoulder and the screw has a head with a projection extending under the shoulder for pulling the injector holder out of the injector holder recess when the screw is screwed out of the cylinder head.

With the particular design of the injector holder and the arrangement of the mounting screw which, during removal, engages the injector holder so as to force the injector holder out of its seat in the mounting recess, the removal of the injector holder is greatly facilitated even if the injector would normally be difficult to remove from the mounting recess. No special tools are required to remove the injector holder.

When the mounting screws is unscrewed the sidewardly projecting rim of the mounting screw which reaches under the shoulder of the injector holder pulls the injector out of its mounting recess.

The invention will become more readily apparent from the following description of an embodiment thereof on the basis of the accompanying drawing.

BRIEF DESCRIPTION OF THE DRAWING

The sole FIGURE is a cross-sectional view of a portion of a cylinder head having a mounting recess with a fuel injector holder and an injector mounted therein.

DESCRIPTION OF A PREFERRED EMBODIMENT

As shown in the FIGURE, an injector holder 1 of a fuel injection system of an internal combustion engine is disposed in a stepped mounting recess 3 in a cylinder head 2 of an internal combustion engine.

The part 1*a* of the injector holder 1 opposite the injection end thereof which projects from the cylinder head 2 into the cylinder head cover 4 has several flattened areas which have different purposes. Two of these flattened areas 5 are disposed diametrically opposite each other and form support surfaces 6 for the fingers 7 of a forked clamping pawl 8. Another flattened area 9 which extends transversely to the two flattened areas 5 is limited by an upper shoulder 10 which serves as an engagement surface for removing the fuel injector holder.

The clamping pawl 8 is disposed with its forked free end on the support surfaces 6 of the injector holder 1 while its other end is disposed on a support surface of the cylinder-head 2.

A mounting screw 11 extends through the clamping pawl 8 and is screwed into the cylinder head 2.

The clamping pawl 8 has a stepped reception hole 12 wherein the screw head 13 with a relatively large-diameter, disc-like outer rim 14 is disposed. The outer rim 14 extends sidewardly into the recess 15 formed by the flattened area 9 in the injector holder 1 and provides, with the upper shoulder 10, for a removal means for removing the injector holder 1.

The screw head 13 of the mounting screw has about the same diameter as the screw shank 16 and is provided internally with a star-shaped recess for receiving a star-type insert range. With such a screw head, the mounting screw can be arranged very close to the injector holder 1 whereby favorable lever and force transmission conditions for the clamping pawl supported on the cylinder head 1 are obtained.

The outer rim 14 which extends into the recess 15 for facilitating the removal of the injector holder 1 is disposed at a distance from the upper shoulder 10 which defines the upper limit of the recess 15, the screw head 13 being disposed partially within the recess 15 and partially outside above the upper shoulder 10 closely adjacent the injector holder 1.

For an exchange of the injector, the injector holder is removed together with the injector 18 from the mounting recess 3 in accordance with the following procedure:

The mounting screw 11 is loosened and unscrewed. During unscrewing of the screw 11 from the cylinder head 1, the outer rim 14 engages the upper shoulder 10 and forces the injector holder 1 out of the mounting recess 3. Special tools are not needed even if the injector holder is stuck in the mounting recess.

The arrangement according to the present invention provides therefore for a simple and effective and easily operable means for removing an injector holder.

The injector holder is mounted by concurrently inserting the injector holder into the mounting recess and screwing the mounting screw 11 into the cylinder head 2 wherein, during mounting, the outer rim 14 must be disposed at the level of the recess 15 in the injector holder.

What is claimed is:

1. A mounting arrangement for mounting a fuel injector holder in an injector holder recess formed in a cylinder head of an internal combustion engine, said mounting arrangement comprising a clamping pawl having one end seated on a support surface of said cylinder head and having an opposite forked end forming engagement fingers seated on support surfaces formed on said injector holder and a screw extending through said clamping pawl and being threaded into said cylinder head for forcing said injector holder into said injector holder recess, said injector holder having a shoulder adjacent said mounting screw and said mounting screw having a head with an annular projection disposed below said shoulder so that, upon unscrewing of said mounting screw, said annular projection engages said shoulder for pulling said injector holder out of said injector holder recess.

2. An arrangement according to claim 1, wherein said shoulder is provided by a recess formed into a side of said injector holder outside said injector holder recess.

3. An arrangement according to claim 1, wherein said projection is a disc-like rim extending from said screw head and below said shoulder.

4. An arrangement according to claim 3, wherein said screw has a shank portion which has essentially the same diameter as said head, said head having a socket with toothed star-like opening for engagement by a star-like toothed insert wrench.

5. An arrangement according to claim 1, wherein said screw head is disposed closely adjacent said injector holder.

* * * * *